US007244046B2

(12) United States Patent
Webb

(10) Patent No.: US 7,244,046 B2
(45) Date of Patent: Jul. 17, 2007

(54) BASKETBALL LIGHT RAISING AND LOWERING APPARATUS AND METHOD

(75) Inventor: Daniel L. Webb, Newburgh, IN (US)

(73) Assignee: SOP Services, Inc., Las Vegas, NV (US)

( * ) Notice: Subject to any disclaimer, the term of this patent is extended or adjusted under 35 U.S.C. 154(b) by 126 days.

(21) Appl. No.: 11/167,326

(22) Filed: Jun. 27, 2005

(65) Prior Publication Data

US 2006/0291221 A1 Dec. 28, 2006

(51) Int. Cl.
*F21V 33/00* (2006.01)

(52) U.S. Cl. ..... 362/253; 362/431; 362/427

(58) Field of Classification Search ..... 362/253, 362/234, 431, 427; 473/481, 484
See application file for complete search history.

(56) References Cited

U.S. PATENT DOCUMENTS

| | | | |
|---|---|---|---|
| 243,406 | A | 6/1881 | Sample et al. |
| 480,470 | A | 8/1892 | Maier |
| 4,984,787 | A | 1/1991 | Nesbit et al. |
| 5,124,899 | A | 6/1992 | Hale |
| 5,305,998 | A | 4/1994 | Nesbit et al. |
| 5,346,207 | A | 9/1994 | Heinen |
| 5,388,821 | A | 2/1995 | Blackburn |
| 5,547,185 | A | 8/1996 | Wagner et al. |
| 5,677,896 | A | 10/1997 | Nunes |
| 5,711,727 | A | 1/1998 | Edge et al. |
| 6,302,811 | B1 | 10/2001 | Topham |
| 6,367,948 | B2 | 4/2002 | Branson |
| 6,626,773 | B1 | 9/2003 | Fair |
| 2001/0040803 | A1 | 11/2001 | Branson |
| 2002/0094890 | A1 | 7/2002 | White et al. |
| 2005/0215357 | A1* | 9/2005 | Guerzini et al. ..... 473/481 |

* cited by examiner

*Primary Examiner*—Renee Luebke
*Assistant Examiner*—Jessica L. McMillan
(74) *Attorney, Agent, or Firm*—Wood, Emhardt, Moriarty, McNett & Henry LLP

(57) ABSTRACT

Certain preferred embodiments of the present invention provide an improved light raising and lowering apparatus and method for a basketball goal. In some improved embodiments, an extension arm with a light attaches to an adjustment mechanism and further attaches pivotally to a basketball goal support structure, where the light moves upward when the adjustment mechanism pulls on the extension arm. As a preferred feature, the extension arm rotates to a raised position where the extension arm may be secured without requiring manual adjustments. As another preferred feature, the light raising and lowering apparatus may be attached to a previously assembled basketball goal.

23 Claims, 14 Drawing Sheets

BASKETBALL LIGHT RAISING AND LOWERING APPARATUS AND METHOD

FIELD OF THE INVENTION

This invention relates generally to lighting for basketball goals and courts that assists game play in low natural light conditions, and more particularly to an apparatus and method for connecting a lighting apparatus that may be raised and lowered in relation to a basketball goal.

BACKGROUND OF THE INVENTION

Various apparatuses and methods for providing light for basketball goals and courts are known. It is known to attach lights to basketball goals and their support structures to provide light in low or less-than-optimal lighting conditions. Some systems are adapted for use with an adjustable basketball goal where the height of the goal may be raised or lowered. An example adjustable basketball goal is described in U.S. patent application Ser. No. 11/087,261, filed Mar. 23, 2005, the entirety of which is hereby incorporated herein by reference. Many systems are difficult to use and do not allow easy accessibility to the lamp for maintenance or for adjusting the lighting angle. Other systems can require strenuous exertion by one or more people to install and/or erect. Still other systems place the lamp behind or above the backboard potentially interfering with vision. Such systems typically require a ladder or disassembly of the basketball goal to access the light for mounting or to change a bulb. An improved apparatus and method for raising and lowering a light for a basketball goal is desired. Certain preferred features of the present invention address these and other needs and provide other important advantages.

SUMMARY OF THE INVENTION

Certain preferred embodiments of the present invention provide an apparatus for illuminating a basketball goal, comprising a basketball goal with a vertical support member and a backboard, where the vertical support member is configured to be vertically oriented during use. The apparatus also comprises an extension arm with a pivot location, a lamp arm, and an actuation arm. The lamp arm and the actuation arm are on opposing sides of the pivot location, and the extension arm is pivotally mounted to the vertical support member at the pivot location. A lamp is mounted to the lamp arm and an adjustment mechanism is connected to the extension arm, where the lamp travels upward when the adjustment mechanism pulls on the extension arm.

In an alternate embodiment of the present invention, a lighting apparatus for a basketball goal comprises a basketball goal with a support structure and a backboard. The lighting apparatus also includes an extension arm attached to the basketball goal support structure, a lamp attached to the extension arm, and an adjustment mechanism. A connecting member is secured to the adjustment mechanism and secured to the extension arm, where the lamp rotates upward when a sufficient force is applied by the adjustment mechanism to the connecting member.

In another embodiment of the present invention, a basketball lighting kit for a basketball goal with an adjustment member includes an extension member pivotally attachable to a basketball goal, a lamp connectable to the extension member, and a connecting member connectable to the extension member and the adjustment member. The extension member, lamp, and connecting member are connectable to form a basketball goal lighting apparatus pivotally connectable to a basketball goal. In use the lamp moves upward when the adjustment member is actuated to pull on the connecting member and the extension member.

In a further embodiment of the present invention, a method for raising and lowering a lighting apparatus for a basketball goal comprises connecting a lamp to an extension arm, pivotally attaching the extension arm to a basketball goal support structure, and connecting an adjustment mechanism to the basketball goal support structure. The method further includes connecting the adjustment mechanism to the extension arm, and applying a tensile force to the extension arm to control the lamp height.

Further objects, features and advantages of the present invention shall become apparent from the detailed drawings and descriptions provided herein. Each embodiment described herein is not intended to address every object described herein, and each embodiment does not include each feature described. Some or all of these features may be present in the corresponding independent or dependent claims, but should not be construed to be a limitation unless expressly recited in a particular claim.

DETAILED DESCRIPTION OF THE ILLUSTRATED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

Certain preferred embodiments of the present invention provide an improved apparatus and method for selectively raising and lowering a lighting apparatus for a basketball goal. In some preferred embodiments, the lighting apparatus is connected to an adjustment mechanism used for raising and lowering the basketball backboard and hoop. The adjustment mechanism provides a mechanical advantage that helps the user raise and lower the lighting apparatus. The adjustment mechanism further holds the lighting apparatus in the raised position without a need for additional tools or for the user to apply additional pressure while allowing the user to secure the lighting apparatus in a desired raised position.

Figure 1:
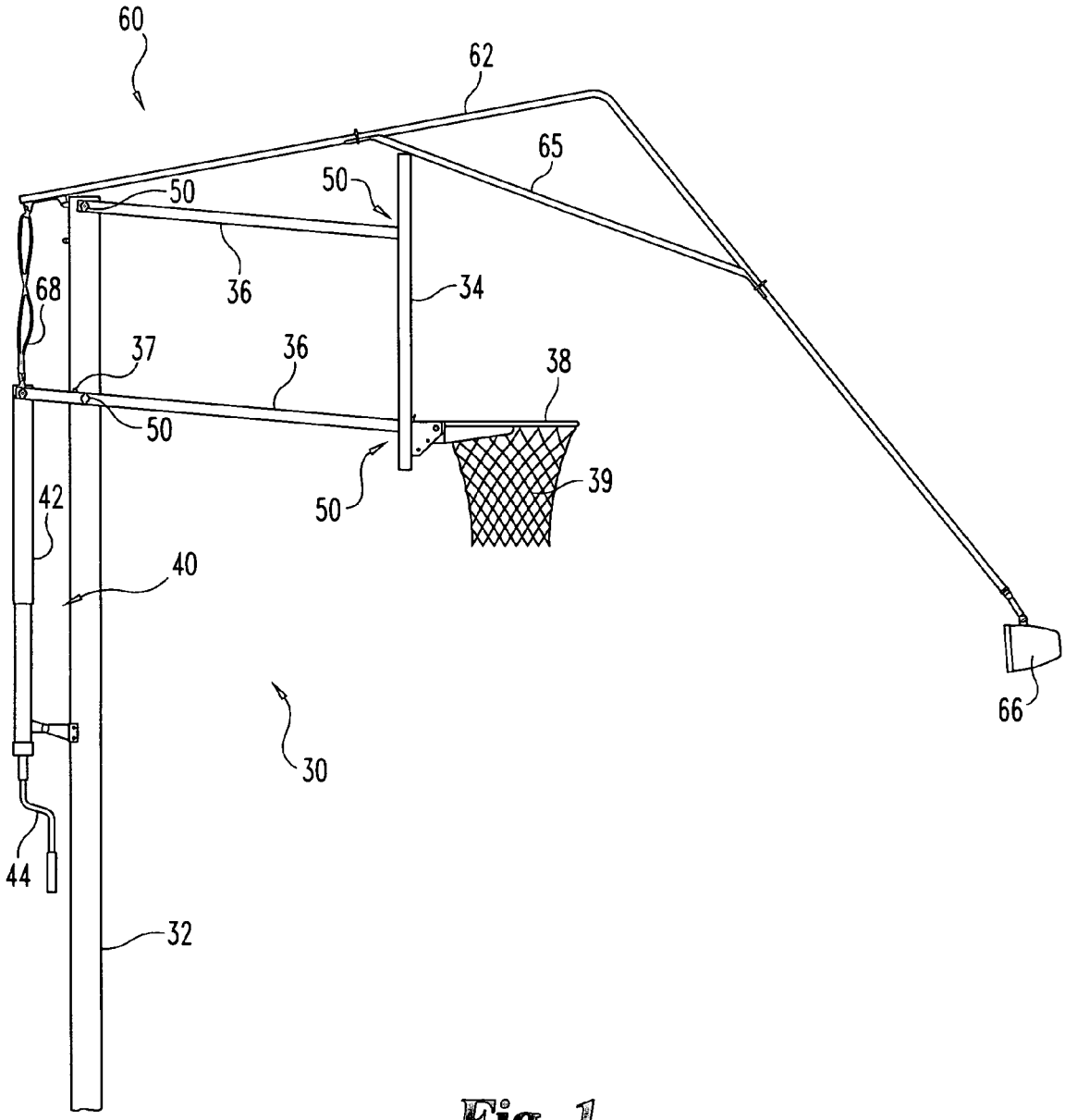
FIG. 1 is a left side elevational view of one embodiment of the present invention with the lighting apparatus and basketball goal in lowered positions.

Illustrated in FIG. 1 is a conventional basketball goal 30 incorporating an adjustment mechanism 40. A lighting apparatus 60 is viewed from one side. The entire goal may be fixed or portable. Basketball goal 30 includes a vertical support member, for example pole 32 which is typically either a round or square pole, backboard 34, adjustable support members 36, stop 37, hoop 38 and net 39. Hoop 38 is attached near the lower edge of backboard 34 and net 39 is attached to hoop 38. Although two adjustable support members 36 are visible in FIG. 1, in alternate embodiments there may be two additional parallel adjustable support members 36 symmetrically located on the opposite side of basketball goal 30 and hidden from view in FIG. 1. Adjustable support members 36 are pivotally attached at pivot locations 50 to pole 32 and backboard 34.

Pole 32, backboard 34 and adjustable support members 36 form a parallelogram when viewed from the side. As backboard 34 raises and lowers in relation to pole 32, backboard 34 is supported by the parallelogram structure which is deformable, but which retains a parallelogram shape. The parallelogram structure enables backboard 34 to be raised and lowered while remaining vertical. In the depicted embodiment, the lower adjustable support member 36 includes a rear extension portion or lever arm which can be used to control the rotation of the parallelogram structure. Stop 37 is preferably provided as a safety device to limit the downward travel of backboard 43. Adjustable support member 36 may optionally be lockable in a fixed position as a safety feature.

Adjustment mechanism 40 can be a type of expansion and retraction cylinder, for example compression cylinder 42 and crank handle 44. Compression cylinder 42 includes two telescoping portions that expand or contract in response to a user rotating crank handle 44. In a preferred embodiment, compression cylinder 42 includes a worm gear that is rotated by handle 44. Adjustment mechanism 40 is pivotally attached to the rear portion of pole 32 and to the rear extension portion of the lower adjustable support member 36. Crank handle 44 may be detachable.

Although depicted as primarily cylindrical in FIG. 1, alternate embodiments of adjustment mechanism 40 include structures that are not cylindrical and still provide a mechanical force advantage useful for raising or lowering either basketball goal 30 and/or lighting apparatus 60. In other embodiments, the adjustment mechanism can include a motor, for example an electric motor. In still other embodiments, an adjustment mechanism includes other means by which a mechanical advantage is provided to raise and/or lower lighting apparatus 60, for example, a lever arm and ratchet system.

Figure 2:
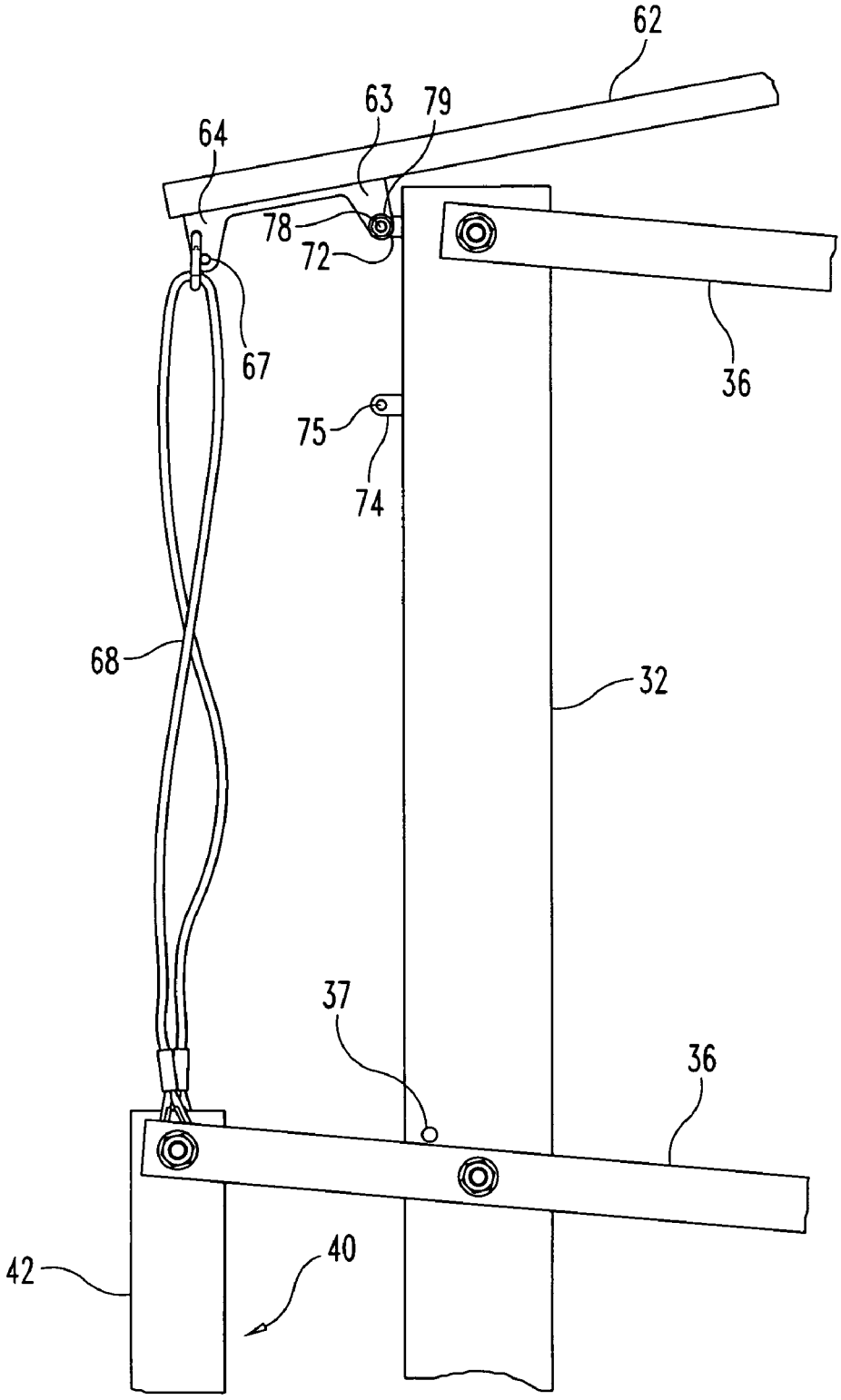
FIG. 2 is a partial left side elevational view of a portion of the embodiment as depicted in FIG. 1.

Referring to FIGS. 1 and 2, lighting apparatus 60 includes extension arm 62 with a lamp arm and an actuation arm, pivot portion 63, securement portion 64, cross-brace 65, and lamp 66. Cross-brace 65 provides support for extension arm 62 to enhance the ability of extension arm 62 to maintain its shape and resist deforming under its own weight or due to external forces, such as wind or the impact of a basketball. Other embodiments utilize different structures for extension arm 62 that similarly allow lamp 66 to be raised and held in a position appropriate for game play.

Extension arm pivot portion 63 and securement portion 64 are welded to extension arm 62, although other alternate embodiments use different means for attaching pivot portion 63 and securement portion 64 to extension arm 62, such as bracket sleeves that fit over or around pole 32, or as other examples clamps, bolts, screws, rivets, or straps. A corresponding basketball pivot portion 72 and a securement portion 74 are welded to pole 32, although alternate embodiments use different means for attaching pivot portion 72 and securement portion 74 to basketball goal 30, such as sleeves that fit over or around extension arm 62 (FIG. 7B), clamps, bolts, screws, rivets, or straps by way of nonlimiting examples.

Extension arm pivot portion 63 is pivotally attached to basketball pivot portion 72. Extension arm pivot portion 63 is typically sized, and may be offset, to provide clearance between extension arm 62 and pole 32 and allow lighting apparatus 60 to rotate from a fully lowered position where extension arm 62 contacts backboard 34 to a fully raised position without contacting pole 32. In the depicted embodiment, lighting apparatus 60 reaches its fully lowered position when backboard 34 is at its lowest position with lighting apparatus 60 optionally resting on backboard 34. In alternate embodiments, lighting apparatus 60 reaches its fully lowered position when extension arm 62 contacts pole 32.

In a preferred embodiment, basketball pivot portion 72 includes two parallel support members, for example two tabs, defining a hole or pivot axis passage. In FIGS. 1-6 the second support member is parallel to and obscured from view by the depicted pivot portion 72. In alternate embodiments, basketball pivot portion 72 includes one, three, or more tabs, each with a hole. The holes in pivot portion 72 align with a hole in a tab forming extension arm pivot portion 63, although in other embodiments there are more than one tab, defining holes that align with the hole or holes in pivot portion 72.

A retaining piece, such as bolt 78, is inserted through the three aligned holes of the pivot axis allowing extension arm 62 to pivot on the basketball pivot portion. A securement device, for example nut 79, is rotated onto bolt 78 to prevent bolt 78 from backing out. In further embodiments, the retaining piece includes pins, dowels, or other means that attach two pieces while allowing the two pieces to pivot. In still further embodiments, the securement device comprises a cotter key, pin, lock nut, wing nut, or other means that helps maintain the retaining piece in position.

As depicted in FIG. 2, extension arm securement portion 64 is attached to adjustment mechanism 40 by a connecting member, for example cable 68. Cable 68 may be attached to extension arm securement portion 64 at a location slightly offset from the length of the extension member, between attachment arm 62 and securement hole 67, although other embodiments attach cable 68 to other locations, for example directly to or wrapped over the extension arm. In still other embodiments, cable 68 may be easily detached from securement portion 64, for example, by including a detachable clip. The location where cable 68 attaches to extension arm securement portion 64 is helpful in providing alignment between securement holes 67 and 75 when extension arm securement portion 64 is rotated downward by actuation of adjustment mechanism 40. Generally, although not necessarily, a location is chosen for cable 68 to attach to extension arm securement portion 64 that provides complete alignment of holes 67 and 75 and clearance for insertion of a retaining piece without requiring additional forces to be applied or manual adjustments to be made by a user. Cable 68 is preferably substantially one piece.

Cable 68 is further attached to adjustment mechanism 40. In the illustrated embodiment, the two eyelet ends of cable 68 are attached in parallel to compression cylinder 42 at the location where compression cylinder 42 attaches to adjustable support member 36. In alternate embodiments, cable 68 may be detachable from adjustment mechanism 40, for example, by including a detachable clip. In still other embodiments, one end of cable 68 is attached to adjustment mechanism 40 with the other end attached to extension arm 62. In still further embodiments, cable 68 can be attached to various locations along the internal and/or external length of the movable portion of compression cylinder 42.

Figure 3:
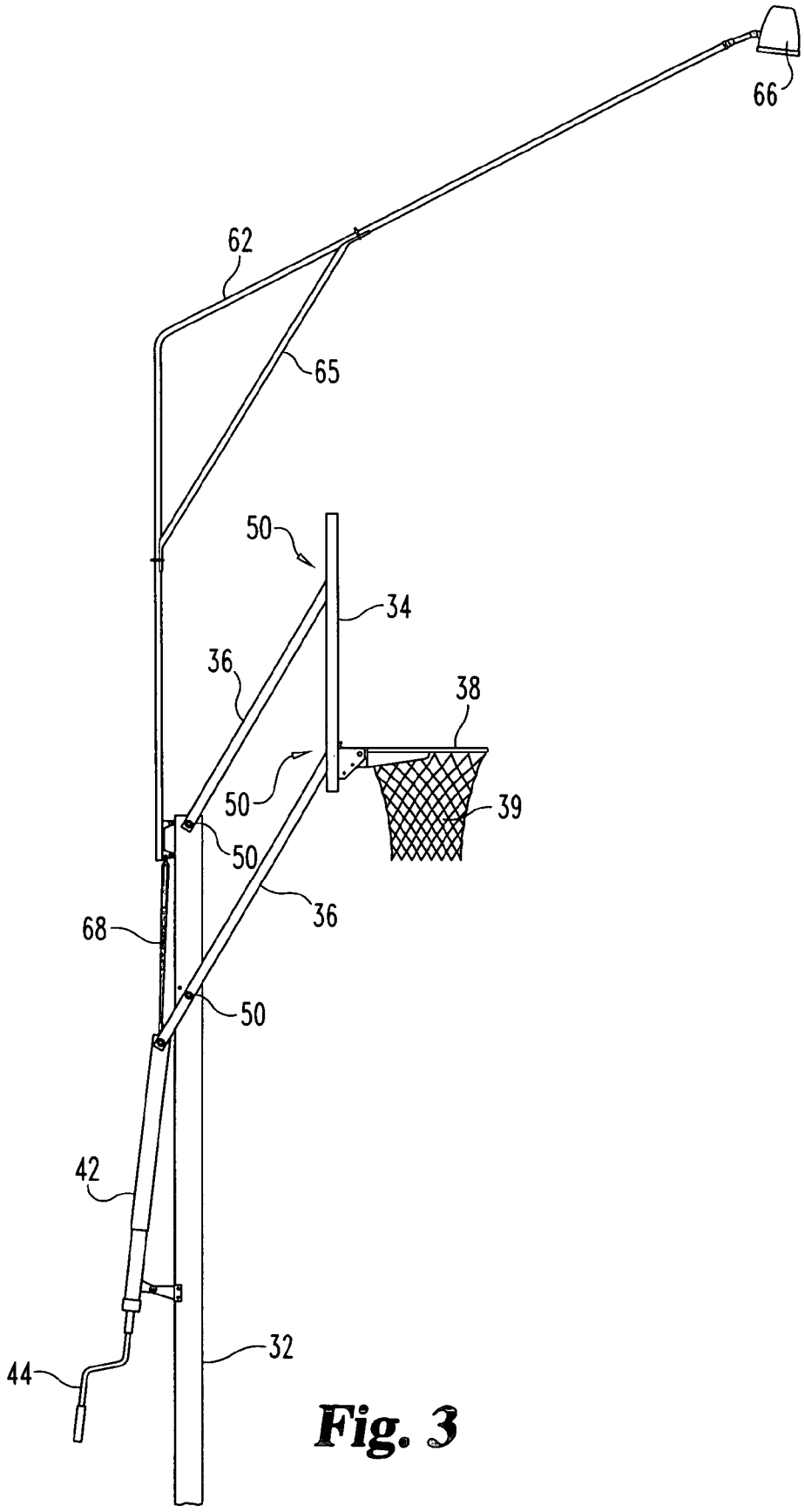
FIG. 3 is a left side elevational view of the embodiment depicted in FIG. 1 with the lighting apparatus and basketball goal in raised positions.
Figure 4:
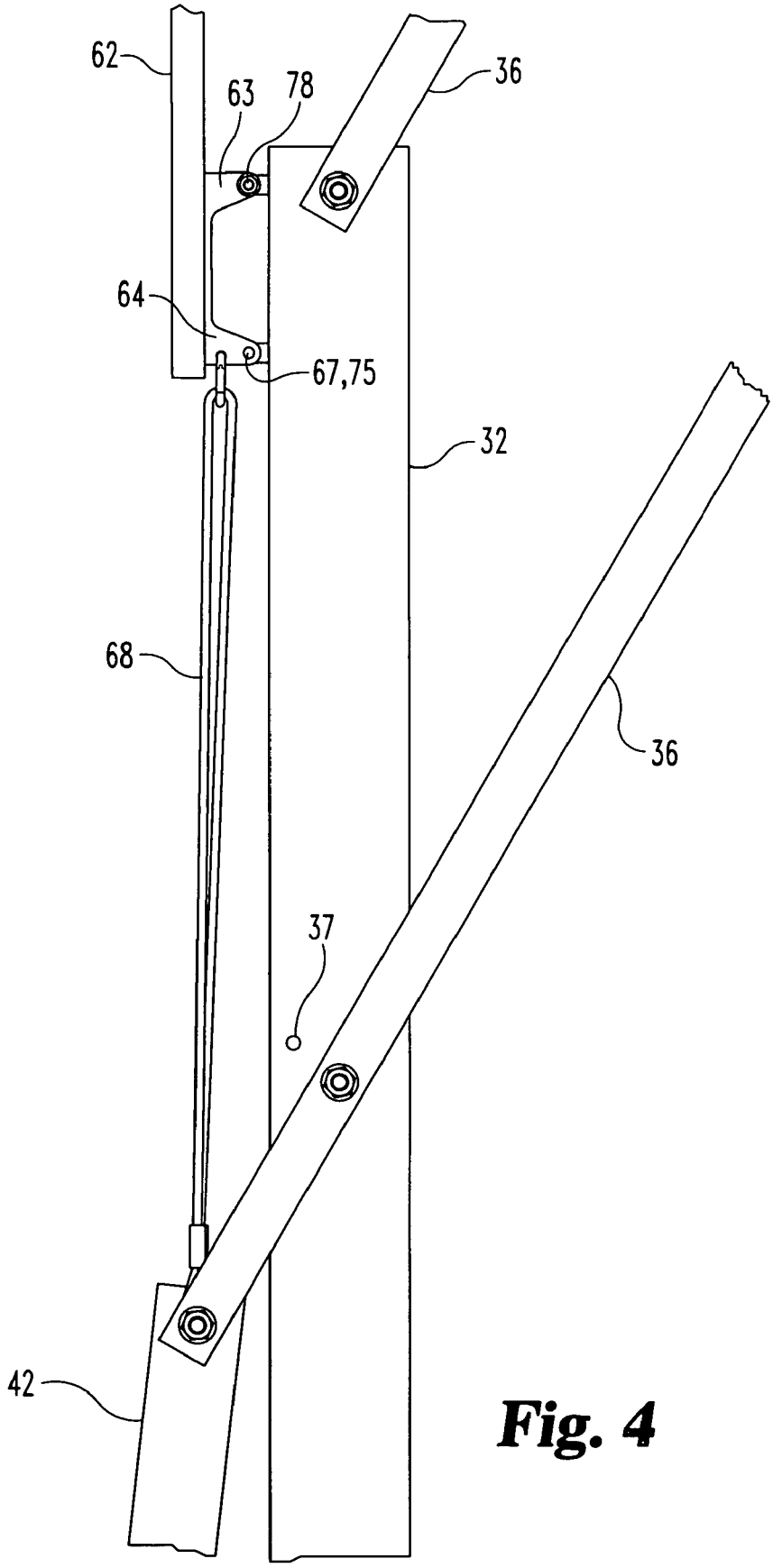
FIG. 4 is a partial left side elevational view of a portion of the embodiment as depicted in FIG. 4.
Figure 6:
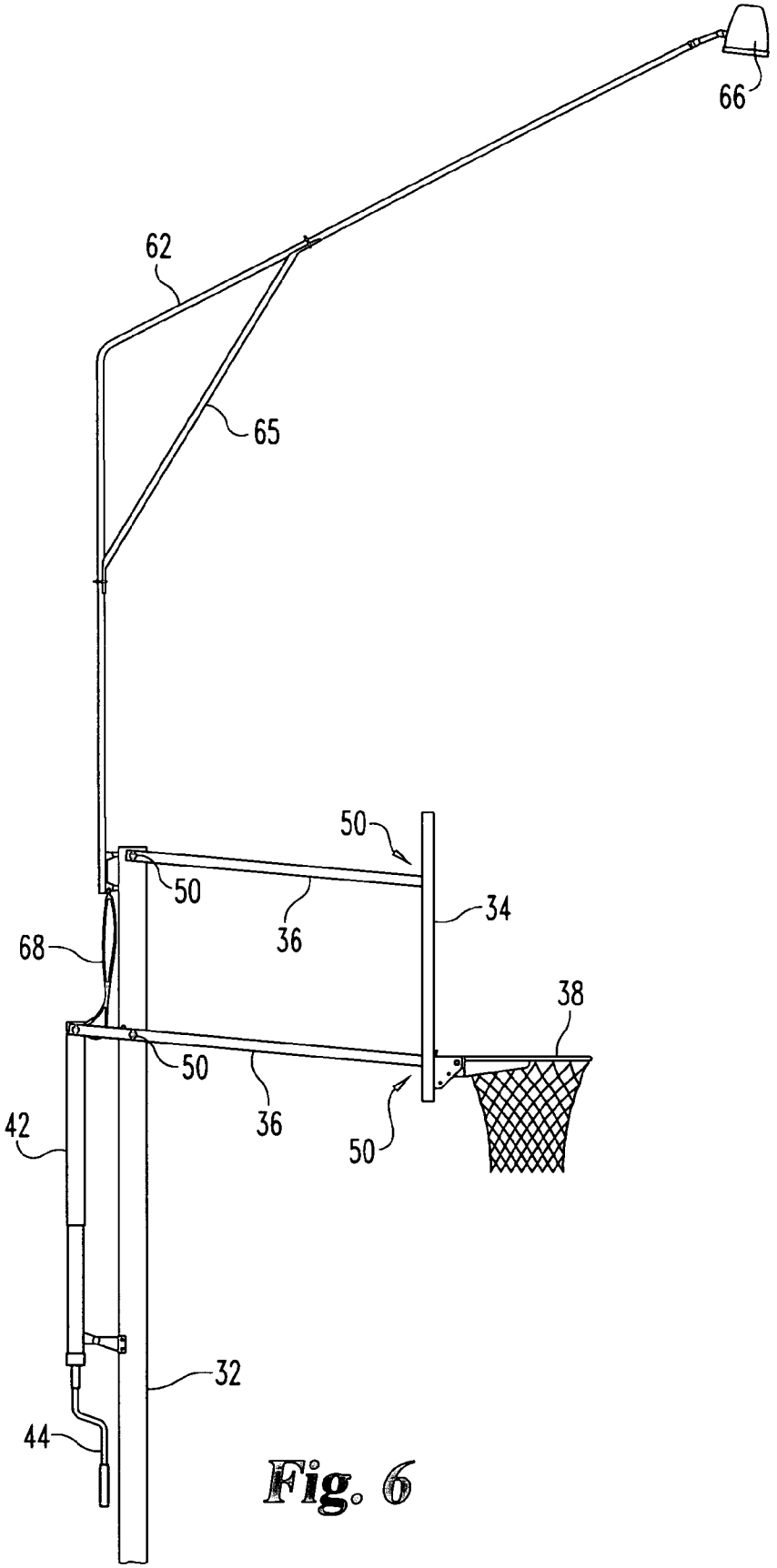
FIG. 6 is a left side elevational view of the embodiment as depicted in FIG. 6.

Lamp 66 is pivotally connected to extension arm 62 (FIGS. 1, 3, and 6). The orientation between extension arm 62 and lamp 66 may be adjusted to provide different lighting angles. As a feature in certain preferred embodiments, the height of lamp 66 above the ground with extension arm 62 in a lowered position is sufficiently low to allow users to access lamp 66 while standing on the ground. The easy accessibility of lamp 66 allows users to easily adjust the lighting angle of lamp 66 as well as perform maintenance to lamp 66, such as changing a burned out light bulb.

When actuated to raise backboard 34, adjustment mechanism 40 preferably pulls downward on the rear extension portion of the lower adjustable support member 36 and raises backboard 34. Simultaneously, cable 68 and extension arm securement portion 64 travel downward. Extension arm 62 rotates to the raised position (FIG. 3) and securement holes 67 and 75 are aligned (FIG. 4) after compression cylinder 42 has compressed an appropriate amount.

It should be appreciated that extension arm 62 and backboard 34 can rotate at different rates. In the illustrated embodiment, extension arm 62 rotates at a faster rate, i.e. has a greater degree of rotation, than backboard 34 due support structure lever arm being longer than the actuation arm of the extension arm. As illustrated, support structure lever arm is between where cable 68 attaches to support member 36 and where support member 36 pivots about pole 32. The actuation arm is between where cable 68 attaches to extension arm 62 and where extension arm 62 pivots about pole 32. During installation, this allows the user to rest extension arm 62 on backboard 34 while attaching cable 68, yet raises the lamp a greater degree of rotation and thus to a greater selected height when operated. This feature is useful to avoid excessive contact between backboard 34 and extension arm 62 that may damage extension arm 62. This feature is also useful when backboard 34 is unable to achieve a height sufficient to push extension arm into a position where securement hole 67 aligns with securement hole 75.

In other, less preferred, embodiments, the lever arm between where cable 68 attaches to support member 36 and where support member 36 pivots about pole 32 is equal to or less than the lever arm between where cable 68 attaches to extension arm 62 and where extension arm 62 pivots about pole 32 such that the extension arm and the backboard may rotate upward at the same speed.

In the illustrated embodiment, securement holes 67 and 75 align without requiring the application of additional force, either by hand or through use of another mechanism or tool; however, other embodiments require the application of additional force or use of additional tools to align securement holes 67 and 75. In an alternate embodiment, a securement bracket, for example a radial bracket plate, may define multiple holes alignable with the extension arm securement hole, allowing the extension arm to be rotated and secured to place the lamp at different heights.

Figure 5:
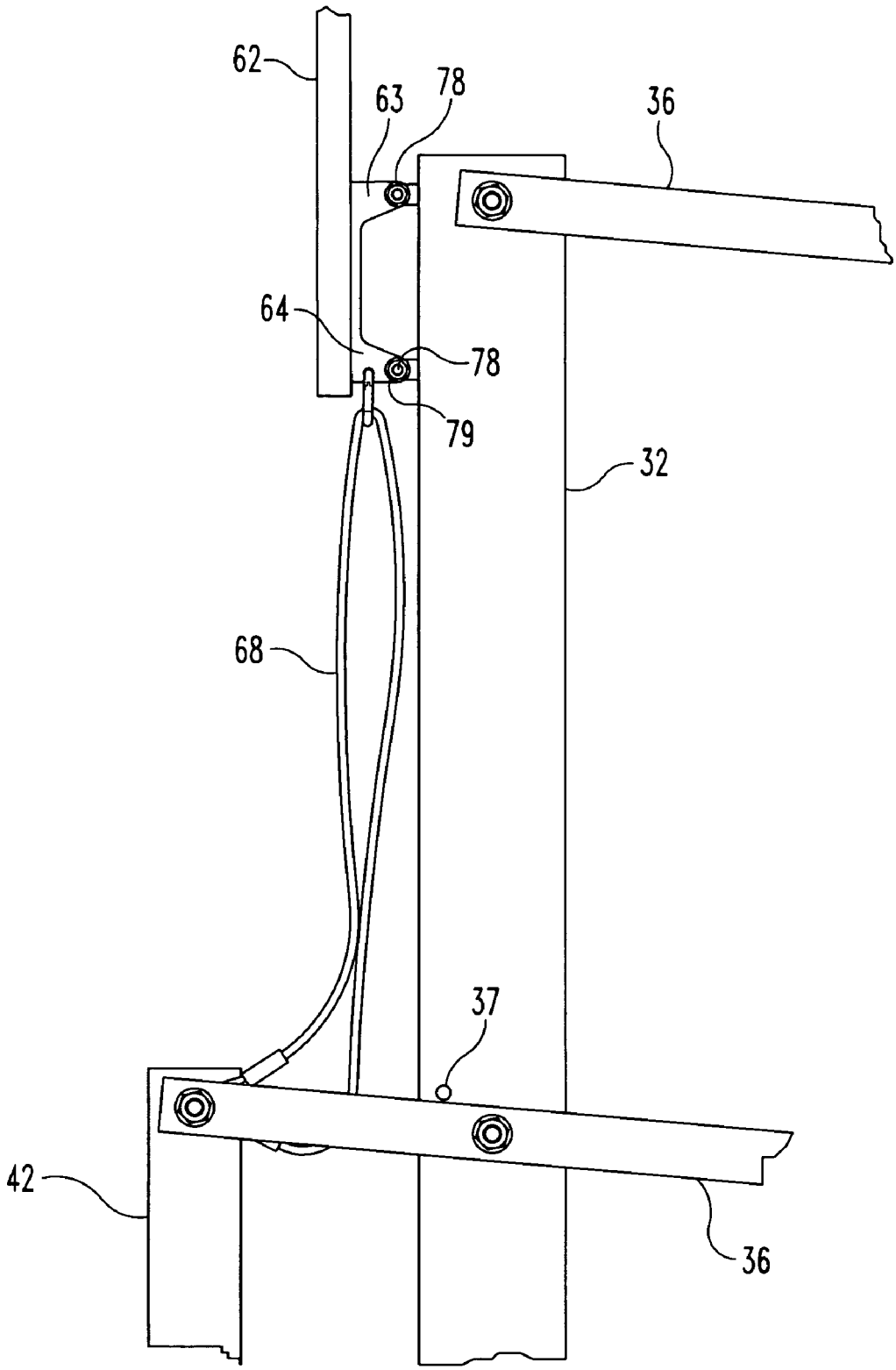
FIG. 5 is a partial left side elevational view of a portion of the embodiment depicted in FIG. 1 with the lighting apparatus in a raised position and the basketball goal in a lowered position.

A retaining piece, such as bolt 78, is inserted through the aligned securement holes 67 and 75 while compression cylinder 42 holds the extension arm to maintain the alignment of holes 67 and 75. A securement means, such as nut 79, is secured to bolt 78 to prevent bolt 78 from backing out (FIG. 5), thereby securing extension arm 62 in the raised position. Once the extension arm is secured in a desired position, the user may reposition backboard 34 to a desired height for game play using adjustment mechanism 40 while extension arm 62 remains in the raised position (FIGS. 5 and 6). In alternate embodiments, extension arm 62 is secured in the raised position using other securement mechanisms that are known in the art, for example latch or catch systems with or without spring-loaded portions. In still other embodiments, extension arm 62 may be secured in more than one raised position by.

Once extension arm 62 is secured in the raised position, cable 68 may be removed or left attached to extension arm 62 and compression cylinder 42 at the user's option. Although the connecting member is depicted as a flexible cable 68 with eyelets at either end, other embodiments utilize types of flexible and non-flexible connecting members such as chains, ropes, rods, beams or tubes. It will also be appreciated that different length connecting members may be utilized. As an example, using a shorter cable 68 than depicted in FIG. 3 results in extension arm 62 reaching the raised position when backboard 34 is at a lower height than that depicted in FIG. 3.

With extension arm 62 secured in a raised position, lamp 66 is located on the same front side of backboard 34 as hoop 38 and net 39. This location is advantageous for directly illuminating backboard 34, hoop 38 and net 39 from the same side of backboard 34 as the players are typically located during play. This location also places lamp 66 is a position where the players do not look directly at or toward lamp 66 when shooting from a variety of locations. If backboard 34 is opaque, locating lamp on the front side of backboard 34 is especially important to avoid backboard 34 casting a shadow on hoop 38. In alternate embodiments, extension arm 62 is located either directly above or behind backboard 34.

The overall length and geometry of extension arm 62 generally places lamp 66 at a satisfactorily distance from hoop 38 to avoid extension arm 62 and lamp 66 from interfering with game play while providing illumination to backboard 34, goal 38 and net 39. Different embodiments utilize different overall lengths and geometries for extension arm 62 to accommodate various game conditions.

Although extension arm 62 is depicted as being connected to adjustment mechanism 40, which also adjusts the height of backboard 34, other embodiments connect extension arm 62 to an adjustment mechanism that does not adjust the height of backboard 34. This arrangement is useful when utilizing the present invention with a backboard that does not have a height adjustment or when the mechanism that adjusts the height of the backboard is not suitable for attachment to lighting apparatus 60.

Figure 7A:
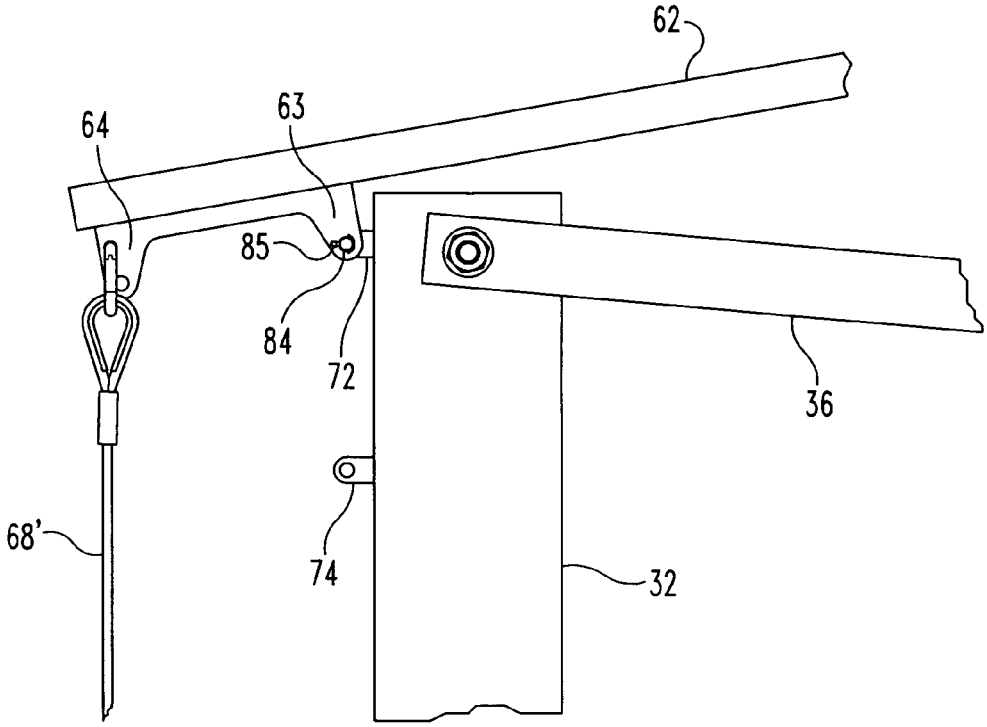
FIG. 7A is a partial left side elevational view of an alternate embodiment of the present invention with the lighting apparatus and basketball goal in lowered positions.

Depicted in FIG. 7A is an alternate embodiment of the present invention where cable 68' is attached to securement portion 64. Cable 68' has one end connected to securement portion 64 and the other end connected to the adjustment mechanism. Additionally, an alternate retaining piece, pin 84 is inserted through the aligned holes in pivot portions 63 and 72 and a cotter key 85 is attached to one end of pin 84 to prevent pin 84 from backing out.

Figure 7B:
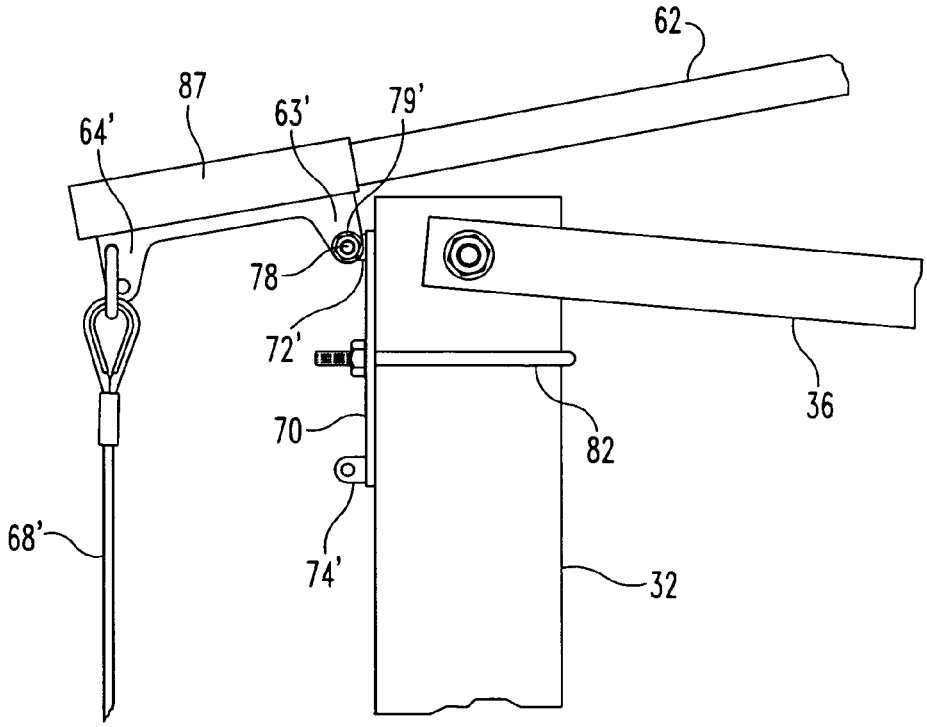
FIG. 7B is a partial left side elevational view of another embodiment of the present invention with the lighting apparatus and basketball goal in lowered positions.

Depicted in FIG. 7B is another embodiment of the present invention which can be retrofit to an existing basketball goal, for example using a base plate 70. As illustrated, base plate 70 includes a pivot portion 72' and securement portion 74'. Base plate 70 is attached to pole 32 by U-shaped bold 82 and two nuts. Alternately, base plate 70 can be attached using bolts or welding.

The actuation arm of extension arm 62 includes pivot portion 63' and securement portion 64' defined on sleeve 87, which is attached to extension arm 62 by fitting sleeve 87 over the end of extension arm 62 and securing sleeve 87 in place by an appropriate means, such as welding, gluing, or bolting. Alternately, two sleeves or mounting pieces can be used to define the pivot portion and the securement portion.

As an example in this embodiment, a lock nut 79' is used to prevent bolt 78 from backing out of the aligned holes in pivot portions 63' and 72'. It should be appreciated that attaching lighting apparatus 60 to pole 32 using base plate 70 does not require disassembly of a previously assembled and erected basketball goal 30. Alternate embodiments use different means to attach lighting apparatus 60 to a preassembled basketball goal 30 without requiring disassembly, for example, using a sleeve that fits over or around pole 32, clamping, bolting, screwing, riveting, or strapping, by way of nonlimiting examples.

Figure 7C:
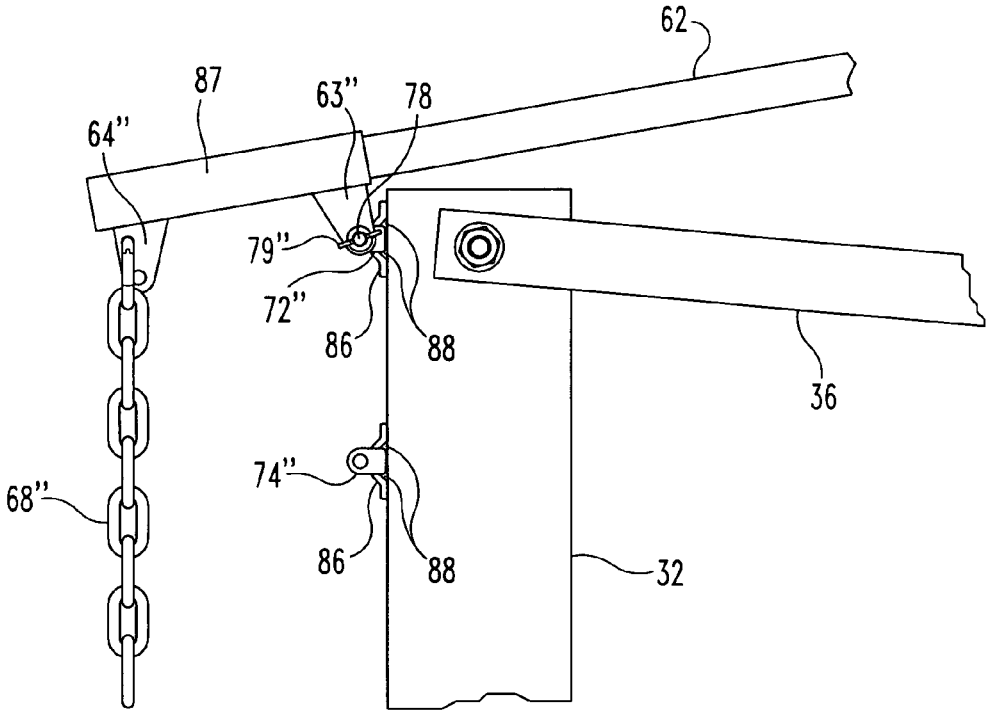
FIG. 7C is a partial left side elevational view of yet another embodiment of the present invention with the lighting apparatus and basketball goal in lowered positions.

Depicted in FIG. 7C is an embodiment with other optional features of the present invention. For example, pivot portion 72" is attached to pole 32 using a bracket 86 assembly. The bracket assembly 86 has a plate with upper and lower portions that are welded to pole 32 and a center portion that is raised above the surface of pole 32 to create an aperture 88 between the plate and pole 32. Two pivot portions 72", typically plates, are each L-shaped. One end of each pivot portion 72" is placed within aperture 88. The opposing ends of the pivot portions are parallel and define aligned holes to form the pivot axis. Bolt 78 is placed through the aligned holes and the extension arm pivot portion 63" and secured to form a pivot, for example with a wing nut 79". Bolt 78 holds the two pivot portions 72" and pivot portion 63" together and prevents disassembly. Securement portion 74" can use a similar arrangement. Also as an example in this embodiment, chain 68" is used to attach securement portion 64" to adjustment mechanism 40.

Figure 7D:
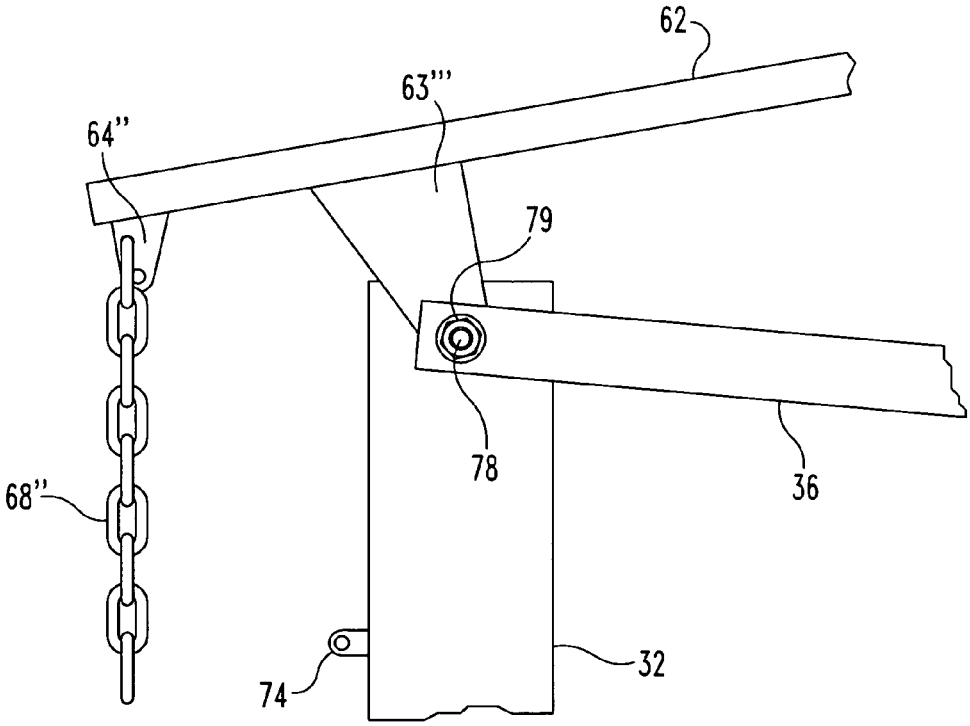
FIG. 7D is a partial left side elevational view of still another embodiment of the present invention with the lighting apparatus and basketball goal in lowered positions.

Depicted in FIG. 7D is yet another embodiment of the present invention with a pivot portion 63'''. Pivot portion 63''' is pivotally attached to pole 32 with the same bolt 78 that attaches the upper adjustable support member 36 to pole 32. Pivot portion 63''' may be attached to an assembled basketball goal 30 by disassembling the connection between upper adjustable support member 36 to pole 32. Alternately, pivot portion 63''' may be attached during assembly of basketball goal 30. In an alternate embodiment, pivot portion 63''' is attached to a separate bolt offset from the upper support member and can be retrofit to an existing support member. Pivot portion 63''' provides a sufficient offset from the extension arm to provide sufficient clearance between extension arm 62 and pole 32 as extension arm 62 rotates and to provide for extension arm 62 to be vertically oriented when securement portions 64" and 74 are connected.

Figure 7E:
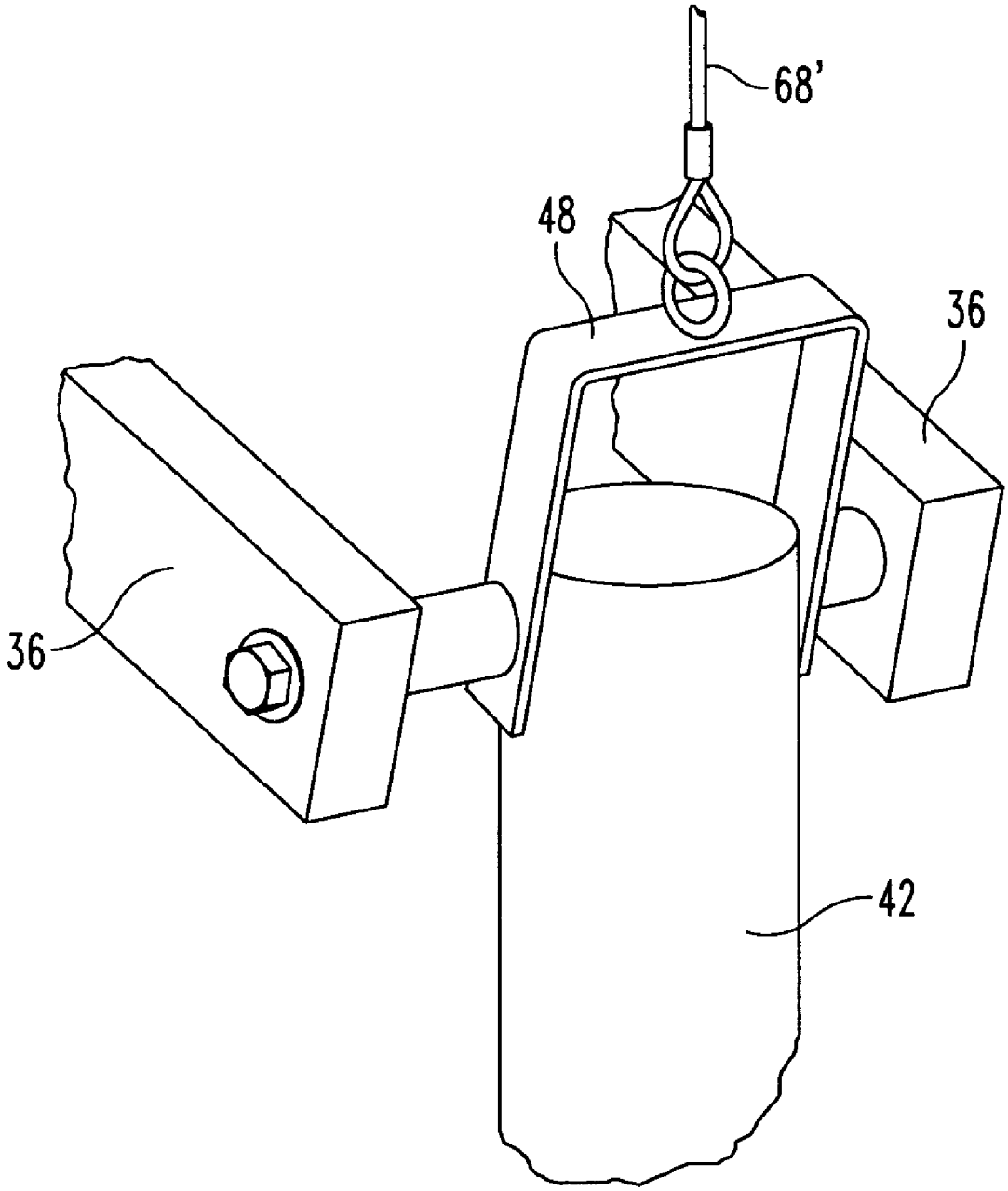
FIG. 7E is a partial, perspective view of an embodiment of the present invention illustrating a connecting member secured to an expansion cylinder with a bracket.

FIG. 7E illustrates an alternate mechanism for attaching connecting member 68' to a compression cylinder 42. In this embodiment, a bracket, such as a U-shaped bracket 48 is pivotally mounted along the pivot axis between arms 36 of the support structure and the compression cylinder 42. Bracket 48 includes a tab or mounting point for securing connecting member 68' to the bracket. In alternate embodiments, bracket 48 can have different widths to be mounted outside or inside of arms 36. The bracket can alternately have more than one tab, or can define an opening through the body of the bracket to which the connecting member can be secured. In certain embodiments, a retaining piece such as a bolt or a clamp (e.g., a carabiner clamp) couple the connecting member to the bracket.

Still other embodiments of the present invention use different means for connecting lighting apparatus 60 to basketball goal 30 that allow extension arm 62 to pivot with respect to goal 30 while providing the capability to selectively secure extension arm 62 to goal 30.

Figure 8B:
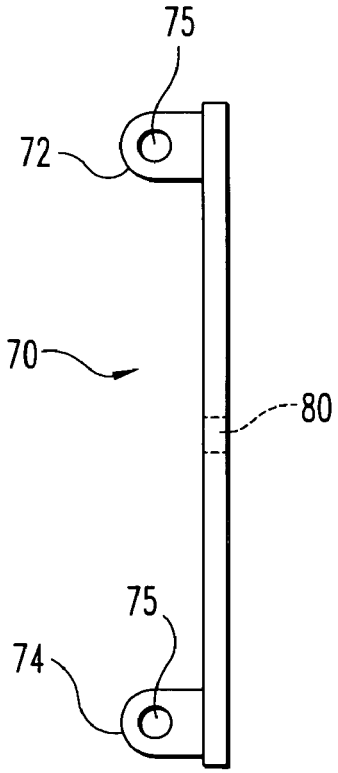
FIG. 8B is left side elevational view of the base plate depicted in FIG. 7B.
Figure 8A:
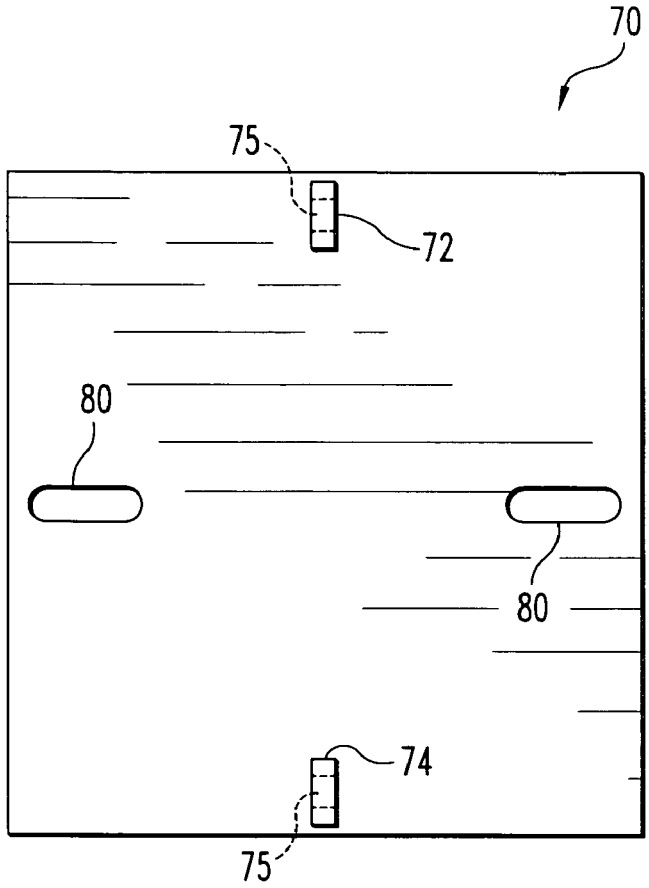
FIG. 8A is a rear elevational view of the base plate depicted in FIG. 7B.
Figure 8C:
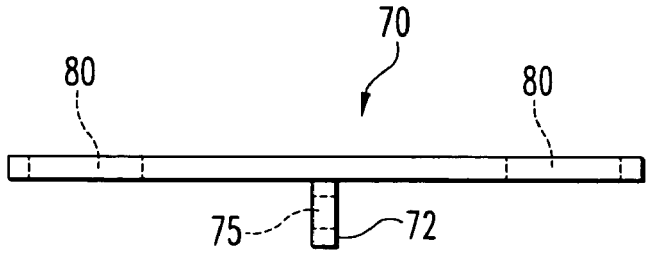
FIG. 8C is a top plan view of the base plate depicted in FIG. 7B.

FIGS. 8A, 8B and 8C include a more detailed view of base plate 70. Base plate 70 is a generally planar member with pivot portion 72, securement portion 74, slots 80, and securement holes 75. In the illustrated embodiment, base plate 70 is primarily constructed from ⅛ inch thick steel cut in a 5¾ inch square. In the illustrated embodiment, pivot portion 72 and securement portion 74 are also constructed from ⅛ inch thick steel. Pivot portion 72 and securement portion 74 are welded to base plate 70 to create a single piece structure, although other means of providing a secure connection may be used. Both pivot portion 72 and securement portion 74 each comprise at least one securement hole 75 which is used to attach base plate 70 to extension arm 62. Slots 80 are used in conjunction with a U-shaped bolt 82 (FIG. 7B) to secure base plate 70 to pole 32. U-shaped bolt 82 is positioned around pole 32 with each end of U-shaped bolt 82 placed through a slot 80. A nut is rotated onto each end of the U-shaped bolt to secure base plate 70 to pole 32.

Slots 80 are generally positioned no closer to the edge of base plate 80 than approximately ⅞ of an inch in order to provide sufficient strength for base plates 70 to attach base plate 70 to pole 32. Pivot portion 72 and securement portion 74 are positioned near the upper and lower edge of base plate 70, respectively, such that the two securement holes 75 are positioned approximately 5 inches apart. The separation between the two securement holes 75 allows base plate 70 to hold extension arm 62 in the appropriate position despite external forces, such as wind or inadvertent contact with a basketball.

Figure 9:
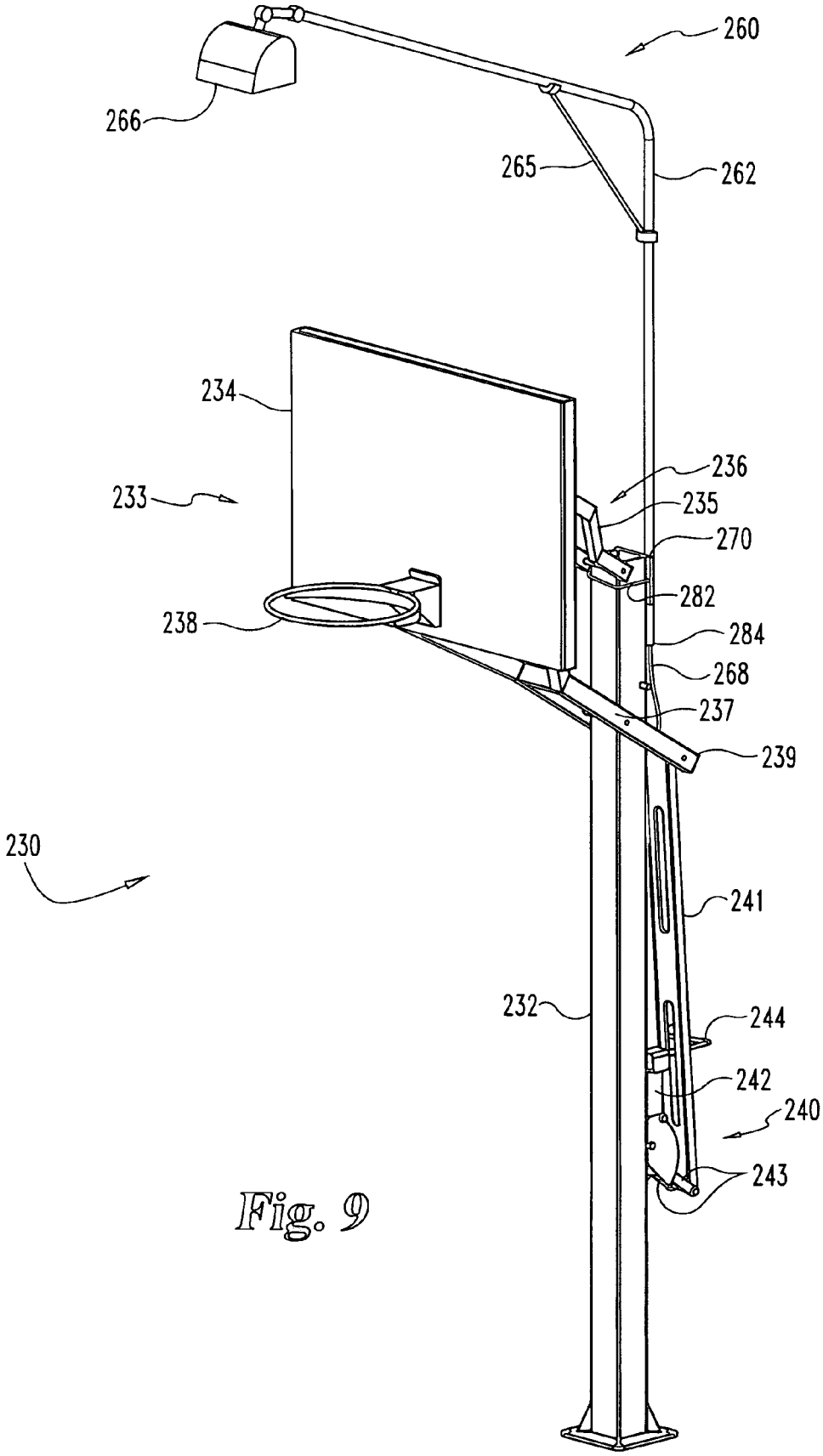
FIG. 9 is a perspective view of an alternate embodiment of the present invention with the lighting apparatus and basketball goal in raised positions.

Illustrated in FIG. 9 is an alternate embodiment of the present invention. Conventional basketball goal 230 incorporates an adjustment assembly or mechanism 240. The entire goal may be fixed or portable. Goal system 230 includes a conventional vertical support element such as a round or square pole 232, and a backboard assembly 233 including a backboard 234 and a hoop 238 in front of the pole. Backboard assembly 233 is adjustably mounted to pole 232 using a parallelogram structure 236. Parallelogram structure 236 includes at least one upper arm 235, preferably two, and at least one lower arm 237, preferably two, extending between pole 232 and backboard assembly 233. As backboard assembly 233 travels upward and downward in relation to pole 232, it is supported by the parallelogram assembly 236 which is deformable, but which retains a parallelogram shape. In a preferred embodiment, one or two of the upper arms 235 or lower arms 237 includes a rear extension portion illustrated as rear extension 239 of lower arms 237, which can be used to control rotation of the parallelogram structure 236.

Rear extension portion or portions 239 is/are connected to one or two parallel adjustment arms 241 pivotally connected at an upper end to the rear extension portion 239. Adjustment arm or arms 241 are secured at the lower end to adjustment mechanism assembly 240, illustrated as including a corresponding one or pair of lever arms 243. Adjustment arm 241 is illustrated as two elongate portions joined in upper, middle and lower locations, although alternate embodiments include two separate and parallel elongate portions. Preferably the lower end of adjustment arm 241 is attached to a lever arms 243 pivotally mounted between pole 232 and adjustment arms 241.

In an optional feature, the mass and weight of the backboard assembly and support structure can be arranged to be all or partially balanced between the front and rear of the pole. Examples of this include incorporating weight or heavier materials in the rear extension portions or adjustment arms to balance the mass of the backboard and forward arm portions. The weight can be an added external or internal mass such as a metal piece, sand or concrete or can be an integral piece such as a solid bar portion. Alternate balance assisting mechanisms include springs or shock absorbers. The balanced mass assists users by only requiring a reduced or minimal force to be applied to the adjustment arms in order to raise and lower the backboard assembly height and avoids the user directly attempting to lift or move the entire weight of the backboard mass.

An actuator assembly 242, for example an extension cylinder, is driven by handle or crank 244. Adjustment assembly 240 is preferably mounted to pole 232 on the rear of the pole in relation to backboard assembly 233, and preferably at a height where crank 244 is easily accessible to users. Crank 244 may be detachable or the adjustment assembly 240 may be lockable in a fixed position as a safety feature. Actuator assembly 242 is pivotally connected to lever arms 243 at a point between where lever arms 243 pivotally connect to pole 232 and adjustment arm 241.

Lighting apparatus 260 includes extension arm 262, cross-brace 265, lamp 266, base plate 270 and U-shaped bolt 282. Lighting apparatus 260 further includes pivot and securement portions (not depicted) connected to extension arm 262 and base plate 270, which provide a selectively securable pivoting attachment between extension arm 262 and base plate 270. The actuation end 284 of extension arm 262 is attached to connecting member 268, which is attached to adjustment arm 241. In alternate embodiments, connecting member 268 is attached to rear extension 239.

When crank 244 is turned to raise backboard assembly 233, actuator assembly 242 expands and parallel adjustment arm 241 moves downward. The downward motion of adjustment arm 241 causes connecting member 268 to pull the actuation end 284 of extension arm 262 downward, thereby raising lamp 266. As should be understood, the opposite motion results when crank 244 is turned to lower backboard assembly 233.

Once crank 244 is turned sufficiently, lighting apparatus 260 reaches a raised position, as depicted in FIG. 9. Lighting apparatus 260 may be secured in a raised position, thereafter allowing the height of backboard assembly to be adjusted without moving lighting apparatus 260 from the raised position. As desired, lighting apparatus may be unsecured, allowing it to be raised and lowered.

Figure 10:
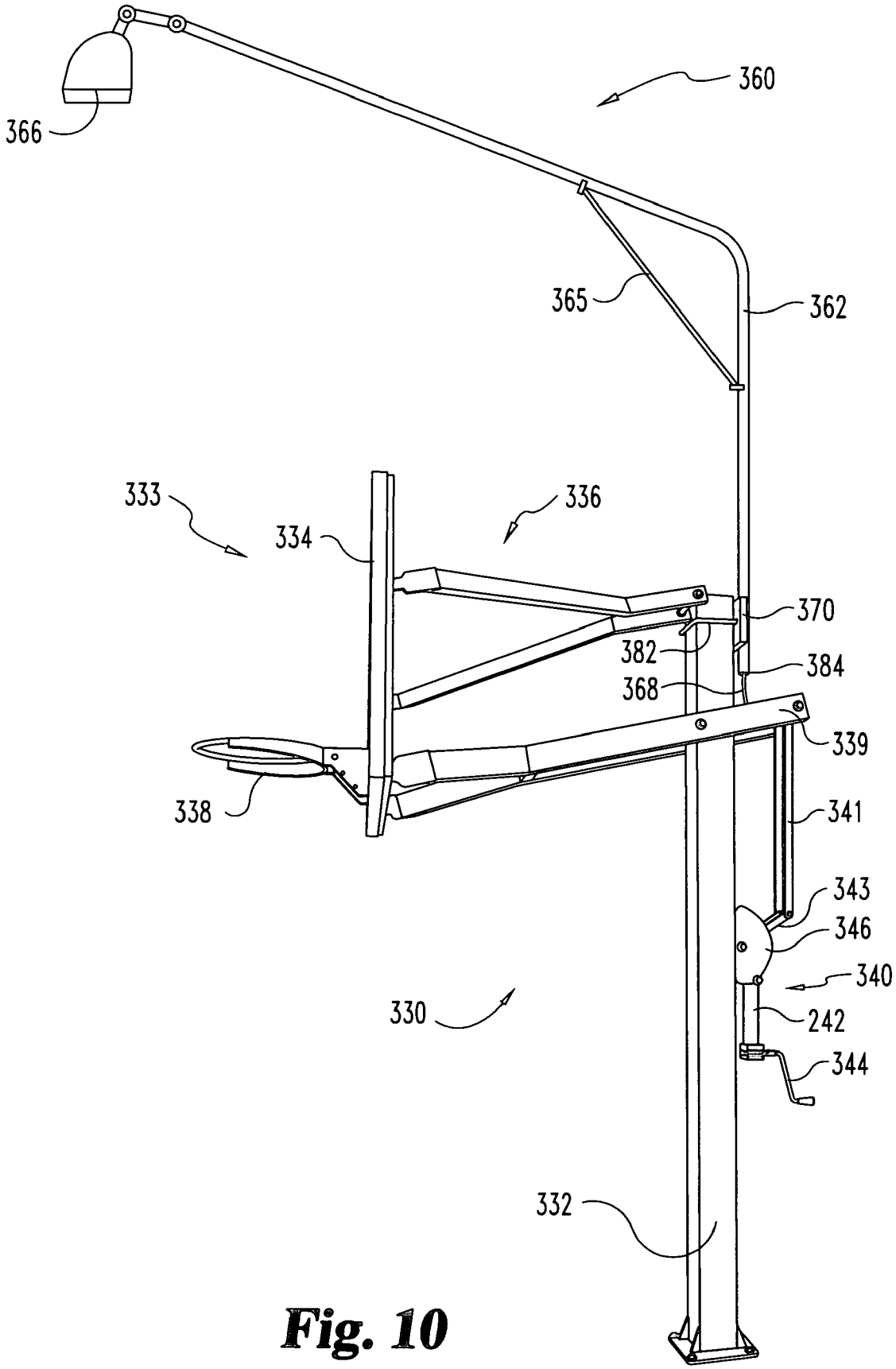
FIG. 10 is a perspective view of yet another alternate embodiment of the present invention with the lighting apparatus in a raised position and the basketball goal in an intermediate position.

Illustrated in FIG. 10 is an alternate version of a basketball goal 330 incorporating an adjustment assembly or mechanism 340 and lighting apparatus 360. Goal 330 includes a vertical support element such as a pole 332, and a conventional backboard assembly 333 including backboard 334 and hoop 338. Backboard assembly 333 is adjustably mounted to pole 332 using a linkage structure 336. Linkage structure 336 includes one or two upper arms and one or two lower arms extending between pole 332 and backboard assembly 333. In certain preferred embodiments, linkage structure 336 includes at least one rear extension portion 339 which can be used to control linkage structure 336 and backboard assembly 333.

Linkage structure 336 further includes an adjustment portion 341, for example one or two adjustment arms, connected at an upper end to rear extension portion 339 and extending downward. Adjustment portion 341 is secured at the lower/opposing end to adjustment mechanism assembly 340, illustrated as including a pair of lever arms 343.

Preferably the linkage structure 336 is attached to lever arms 343 which communicate between pole 332 and the linkage structure. Adjustment assembly 340 includes optional bracket plates 346 and an actuator 342 driven, for example, by a rotatable handle 344. Adjustment assembly 340 is preferably mounted to pole 332 on the rear of the pole in relation to backboard assembly 333, and preferably at a height where handle 344 is easily accessible to users.

Lighting apparatus 360 includes extension arm 362, cross-brace 365, lamp 366, base plate 370 and U-shaped bolt 382. Lighting apparatus 360 further includes pivot and securement portions (not depicted) connected to extension arm 362 and base plate 370, which provide a selectively securable pivoting attachment between extension arm 362 and base plate 370. The end portion 384 of extension arm 362 is attached to connecting member 368, which is attached to adjustment arm 341. In alternate embodiments, connecting member 368 is attached to rear extension 339.

When actuator 342 contracts, lever arms 343 rotate downward and adjustment portion 341 moves downward. The downward motion of adjustment portion 341 moves rear extension portion 339 downward, causing backboard assembly 333 to move upward and connecting member 368 to move downward. The downward motion of connecting member 368 causes a downward rotation of end portion 384, which causes lamp 366 to rotate upward. As should be understood, the opposite motion results when actuator 342 expands.

Once actuator 342 contracts a sufficient amount, lighting apparatus 360 reaches a raised position, as depicted in FIG. 10. Lighting apparatus 360 may be secured in the raised position, thereby allowing slack in the connecting member and the height of backboard assembly to be adjusted without moving lighting apparatus 360 from the raised position.

Figure 11A:
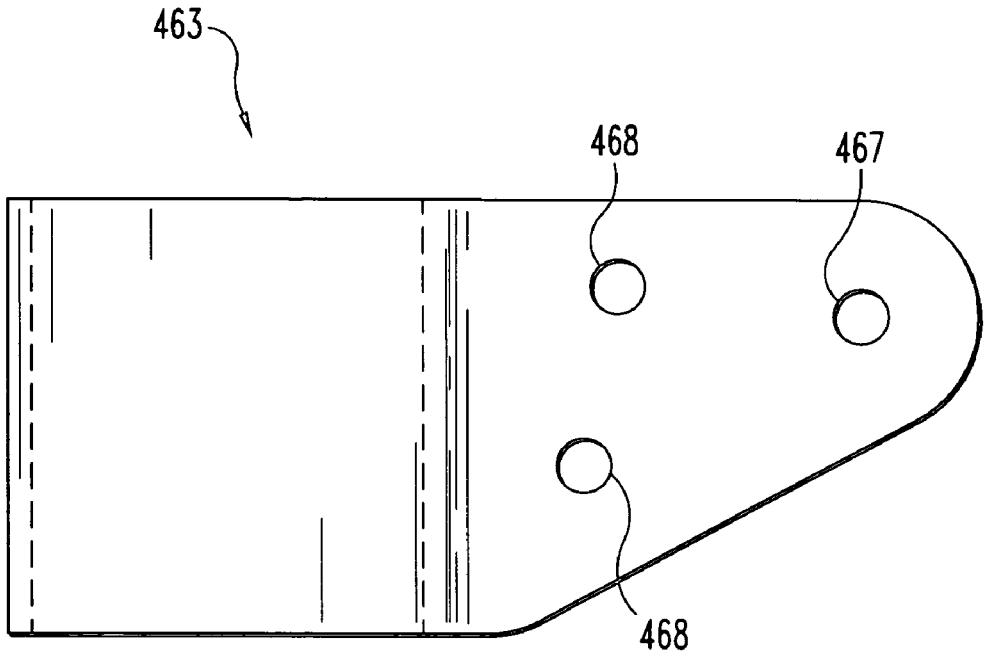
FIG. 11A is a left side elevational view of an attachment portion according to another embodiment of the present invention.
Figure 11B:
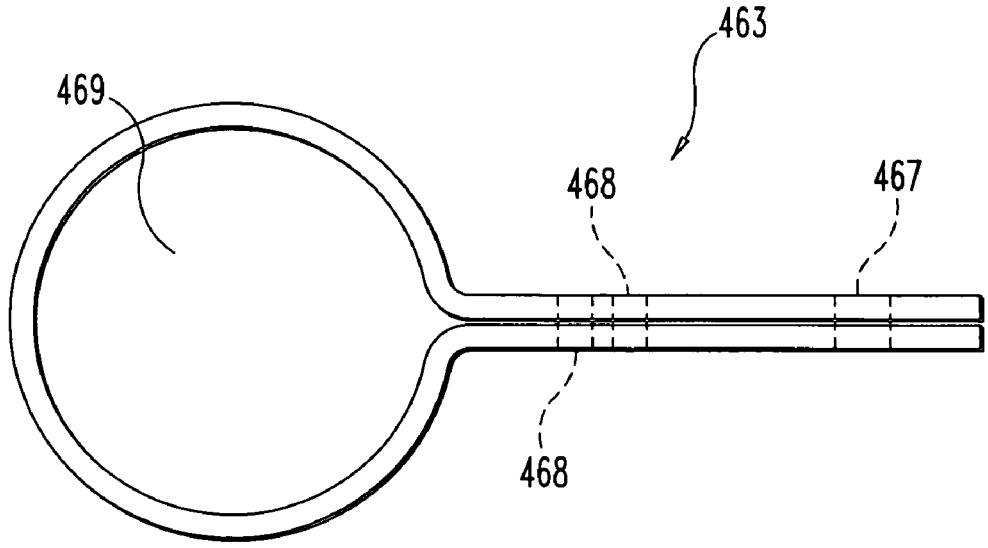
FIG. 11B is a top plan view of the attachment portion depicted in FIG. 8A.

Depicted in FIGS. 11A and 11B is an attachment portion embodiment 463 that may be used with an extension arm 62. Attachment portion 463 may attached to extension arm 62 at either the pivot or securement portion positions. Attachment portion 463 includes securement hole 467 and two additional holes 468. In the illustrated embodiment, attachment portion 463 is comprised of 16 gauge steel that is cut into the appropriate shape and bent to achieve the form depicted in FIGS. 11A and 11B, which includes aperture 469 for receiving extension arm 62. Once extension arm 62 is placed in aperture 469, a bolt is placed through one of the additional holes 468 and a nut is rotated onto the end of the bolt to secure attachment portion 463 to extension arm 62.

The second additional hole 468 is available for attachment to cable 68 or for placement of an additional bolt and nut to provide additional securement of attachment portion 463 to extension arm 62. Securement hole 467 is used to attach attachment portion 463 to either a pivot portion or a securement portion. Alternate embodiments of the attachment portion use different configurations and different materials while providing a pivotal attachment between extension arm 62 and pole 32 that may be secured in at least one set position.

Figure 12A:
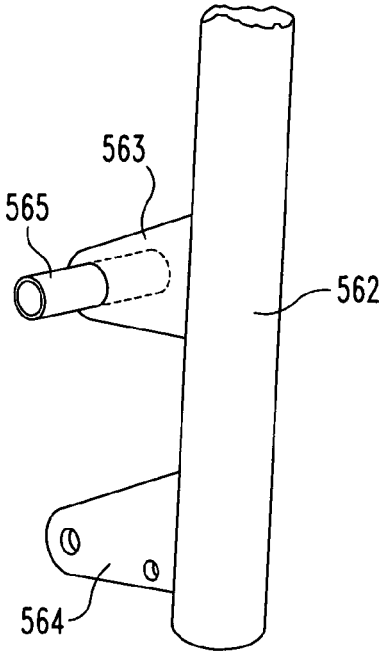
FIG. 12A is a perspective view of an end of the extension arm according to one embodiment of the present invention.
Figure 12B:
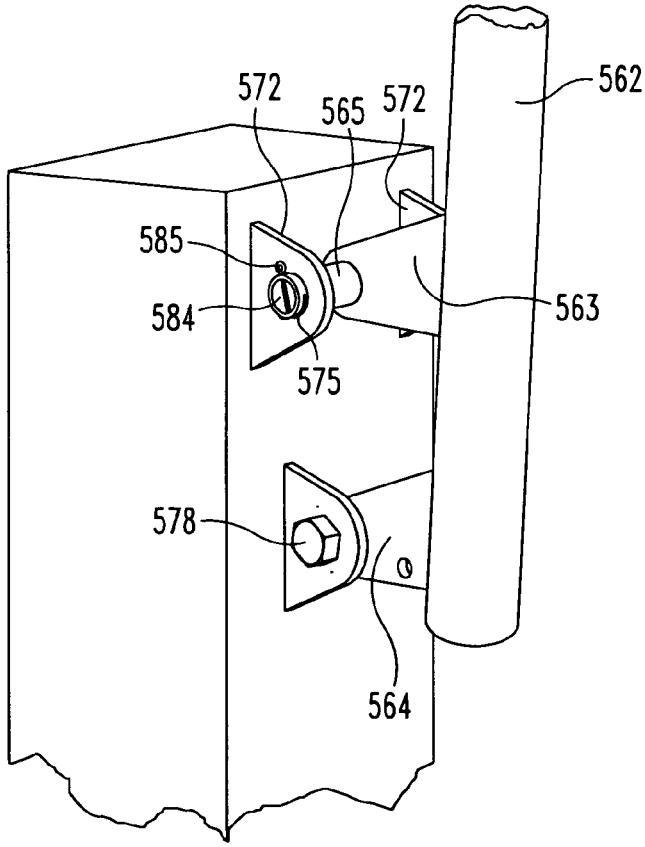
FIG. 12B is a perspective of view of the end of the extension arm of FIG. 12A attached to a basketball goal.

FIGS. 12A and 12B illustrate an alternate embodiment of the actuation arm end of an extension arm 562. In this embodiment, extension arm 562 includes a pivot tab 563 having a welded steel tube 565 aligned with the pivot axis. A securement tab 564 is located adjacent the end of the extension arm. Extension arm 562 can be mounted to a vertical support 532 with the steel tube 565 aligned with pivot holes 575 in parallel tabs 572 on the support. A pivot member 584, such as a bolt or rod, passes through the tabs and tube, and is secured on either side, for example with cotter pin 585. Tube 565 assists in making the pivot connection more rigid, for example to prevent warping or torque due to wind load. Securement tab 564 can be coupled to a corresponding tab on the vertical support, and fixed in place, for example with bolt 578.

One embodiment provides an apparatus for illuminating a basketball goal, comprising a basketball goal with a vertical support member and a backboard, where the vertical support member is configured to be vertically oriented during use. An extension arm defines a pivot location, a lamp arm, and an actuation arm, with the lamp arm and the actuation arm being on opposing sides of the pivot location. The extension arm is pivotally mounted to the vertical support member at the pivot location. A lamp is mounted to the lamp arm. An adjustment mechanism is connected to the extension arm, causing the lamp to travel upward when the adjustment mechanism pulls on the extension arm.

An alternate embodiment provides a kit with an extension member pivotally attachable to a basketball goal having a vertical support and a backboard adjustment member. A lamp is connectable to the extension member; and, a connecting member is connectable between the extension member and the adjustment member. The extension member, lamp, and connecting member are connectable to form a basketball goal lighting apparatus pivotally connectable to the vertical support; and, in use the lamp moves upward when the adjustment member is actuated to pull on the connecting member.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. Dimensions are not intended to be limiting and may be altered as would be understood by one of ordinary skill in the art.

What is claimed is:

1. An apparatus for illuminating a basketball goal, comprising:

a basketball goal with a vertical support member and a backboard, said vertical support member configured to be vertically oriented during use;

an elongate extension arm with a pivot location, wherein said extension arm defines a lamp arm portion extending forwardly over said backboard, and an actuation arm portion extending rearwardly, said lamp arm portion and said actuation arm portion being on opposing sides of said pivot location, wherein said extension arm is pivotally mounted to said vertical support member at said pivot location;

a lamp mounted to said lamp arm portion; and, an adjustment mechanism connected to said actuation arm portion of said extension arm, wherein said lamp travels upward when said adjustment mechanism pulls on said extension arm.

2. The apparatus as recited in claim 1, wherein said adjustment mechanism is mounted to said vertical support member.

3. The apparatus as recited in claim 2, wherein said adjustment mechanism is connected to said extension arm at a point along the length of said actuation arm portion.

4. The apparatus as recited in claim 1 wherein said adjustment mechanism comprises a connecting member connected to said extension arm.

5. The apparatus as recited in claim 4, wherein the basketball goal further comprises a backboard support between said backboard and said vertical support member, wherein said backboard support is pivotally mounted at a support pivot point to said vertical support member and having a lever arm extending rearwardly from said support pivot point to control pivotal movement of said support and said backboard, wherein said adjustment mechanism is connected to said lever arm, and wherein the distance from said support pivot point to the adjustment mechanism connection point along said lever arm is longer than the distance along said extension arm from said extension arm pivot location to the point where said adjustment mechanism is connected to said actuation arm portion.

6. The apparatus as recited in claim 4, wherein said connecting member is disengagable from said actuation arm.

7. The apparatus as recited in claim 4, wherein said connecting member is flexible.

8. The apparatus as recited in claim 4, wherein said connecting member is a cable.

9. The apparatus as recited in claim 4, wherein said extension arm includes a securement portion selectively securable to said vertical support member to fix said extension arm in an operating position in relation to said vertical support member.

10. The apparatus as recited in claim 9, wherein said lamp is positioned forward of said backboard and aimed to illuminate the front side of said backboard when said lamp and extension arm are secured in an operating position.

11. The apparatus as recited in claim 1, wherein said basketball goal includes a deformable parallelogram support structure between said backboard and said vertical support member to maintain said backboard in a vertical orientation while providing for said backboard to be positioned at selected heights above the ground, and wherein said adjustment mechanism is further connected to said parallelogram support structure to control pivotal movement of said support structure.

12. The apparatus as recited in claim 11, wherein operation of said adjustment mechanism causes both said extension arm and said backboard to pivot and wherein said extension arm pivots a greater degree of rotation than said backboard.

13. The apparatus as recited in claim 1, further comprising a securement mechanism connectable between said vertical support member and said extension arm, wherein said securement mechanism maintains said extension arm in a position independent from movement by said adjustment mechanism.

14. A lighting apparatus for a basketball goal, comprising:

a basketball goal with a support structure and a backboard;

an extension arm rotatably attached to said support structure;

a lamp attached to said extension arm;

an adjustment mechanism mounted to said basketball goal; and, a connecting member secured to said adjustment mechanism and secured to said extension arm, wherein said lamp rotates upward on said extension arm when a sufficient force is applied by said adjustment mechanism to said connecting member.

15. The lighting apparatus of claim 14, wherein said connecting member applies a tensile force to said extension arm.

16. The lighting apparatus of claim 14, wherein said adjustment mechanism is connected to said support structure.

17. The lighting apparatus of claim 14, wherein said adjustment mechanism includes a worm gear.

18. The lighting apparatus of claim 14, wherein said backboard is rotatable by operation of said adjustment mechanism, and wherein said adjustment mechanism causes said extension arm and said backboard to rotate, wherein during adjustment said extension arm rotates a greater degree of rotation than said backboard.

19. A basketball lighting kit, comprising:

an extension member pivotally attachable to a basketball goal having a vertical support and a backboard adjustment member mounted to said vertical support;

a lamp connectable to said extension member; and, a connecting member connectable between said extension member and the adjustment member;

wherein said extension member, lamp, and connecting member are connectable to form a basketball goal lighting apparatus pivotally connectable to the vertical support; and, wherein in use said lamp moves upward when the adjustment member is actuated to pull on said connecting member.

20. The kit as recited in claim 19, further comprising:

a piece defining a pivot point mountable to the basketball goal at said pivot point;

a piece defining a securement point mountable to the basketball goal; and, means for securing said extension member to said pivot point and means for securing said extension member to said securement point.

21. A method for raising and lowering a lighting apparatus for a basketball goal, comprising:

connecting a lamp to an extension arm;

pivotally attaching the extension arm to a basketball goal support structure;

connecting an adjustment mechanism to the basketball goal support structure;

connecting the adjustment mechanism to the extension arm;

applying a tensile force to the extension arm by the adjustment mechanism; and, raising the lamp upward.

22. The method of claim 21, further comprising:

rotating the extension arm into a securable alignment with the basketball goal.

23. The method of claim 22, further comprising:

securing the extension arm to the basketball goal support structure, wherein said securing maintains the lamp in an operating position forward of and aimed toward a basketball goal backboard.

* * * * *